US005178276A

United States Patent [19]

Sheets

[11] Patent Number: 5,178,276

[45] Date of Patent: Jan. 12, 1993

[54] BOTTLE STACKING APPARATUS

[76] Inventor: Kerney T. Sheets, P.O. Box 771, Babin Rd., Duplessis, La. 70728

[21] Appl. No.: 841,605

[22] Filed: Feb. 25, 1992

[51] Int. Cl.[5] ..... B65D 75/00

[52] U.S. Cl. ..... 200/427; 206/508; 206/821; 206/503

[58] Field of Search ..... 206/508, 821, 427, 486, 206/520, 562, 503

[56] References Cited

U.S. PATENT DOCUMENTS

| | | | |
|---|---|---|---|
| 2,078,135 | 4/1937 | Griffiths | 206/821 |
| 2,100,035 | 11/1937 | Merrick | 206/821 |
| 2,100,483 | 11/1937 | Jesser | 206/821 |
| 3,336,142 | 8/1967 | Lawson | 206/821 |
| 4,582,447 | 4/1986 | Ztoh | 206/821 |
| 4,848,573 | 7/1989 | Salacuse | 206/508 |
| 4,967,907 | 11/1990 | Pozzi | 206/821 |
| 5,038,961 | 8/1991 | Watanabe et al. | 206/821 |

*Primary Examiner*—Joseph Man-Fu Moy

*Attorney, Agent, or Firm*—Pravel, Gambrell, Hewitt, Kimball & Krieger

[57] ABSTRACT

A support apparatus for stacking bottles of water in a vertical fashion one atop the other includes a bottom support having an inclined side wall with a lower annular rim that fits against the top end portion of a lowermost bottle. An upper support registers with the bottom support and includes a plurality of radially extending struts that provide a surface for conforming to the bottom of an uppermost bottle.

8 Claims, 1 Drawing Sheet

BOTTLE STACKING APPARATUS

BACKGROUND OF THE INVENTION

1. Field of the Invention

The present invention relates to devices for stacking large bottles such as five gallon bottles of drinking water and the like and more particularly relates to an improved apparatus for facilitating the stacking of narrow-mouth bottles in vertical fashion, one atop the other.

2. General Background

In the bottled water industry, there are provided a number of containers for folding and dispensing bottled water, spring water, mineral water and the like. One of the most common of these bottles is a five gallon bottle having a generally cylindrical overall shape including a cylindrical side wall, a flat circular lowermost surface, a narrow neck region and a narrow outlet. Examples of such five gallon bottles are commercially available, one such bottle under the trademark "Liqui-box". An example of such a five-gallon bottle for containing mineral water and/or spring water or the like can be seen in U.S. Design Pat. No. D270,136.

One of the problems with the sale and distribution of spring water, mineral water and the like is that the bottles are rather large and storage is a problem. Thus, there is a need for a simple yet workable method and apparatus for stacking bottles of spring water such as the five gallon commercially available bottles in a compact storage area.

SUMMARY OF THE PRESENT INVENTION

The present invention provides an improved apparatus for stacking a pair of narrow neck type bottles including an upper bottle and a lower bottle. The apparatus allows the upper bottle to be stacked vertically above the lower bottle. When the two bottles are so placed in vertical, stacked position, the central vertical axes of the two bottles is aligned along a common vertical line.

The apparatus includes a lowermost support portion that includes an upstanding annular side wall with a lowermost annular surface adapted to engage the upper end portion of the lower bottle.

A generally flat upper surface is connected to the top end portion of the annular side wall and provides a cylindrical hub with a central opening for accommodating the neck portion of the lower bottle. This cylindrical hub and its internal cylindrical opening helps register the lowermost support upon the lower bottle and also aligns the side wall of the lowermost support with the lower bottle, preventing lateral movement of the lowermost support with respect to the lower bottle.

An upper connection member extends away from the hub and is supported by the upper surface of the lowermost support. The upper connection member includes a flat annular area that extends beyond the annular side wall and has an uppermost surface that conforms generally to the bottom of an upper bottle to be stacked.

The side wall is preferably inclined or frustroconical in shape.

The lowermost annular surface is preferably a circular surface that defines a plane. The flat upper surface of the lower support also includes a flat surface that defines a plane so that the plane of the flat upper surface is generally parallel to the plane of the lower annular surface of the lower support. The cylindrical hub is sized to closely register with the neck and top of the lower bottle. In this manner, the cylindrical hub, in combination with the flat planar surface of the lower support and the lower annular surface of the lower support provides geometry that insures vertical orientation of both the lower bottle and the upper bottle. Additionally, this geometry aligns the vertical axis of the upper bottle and lower bottle during use so that a very stable stacking arrangement is maintained.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 3:
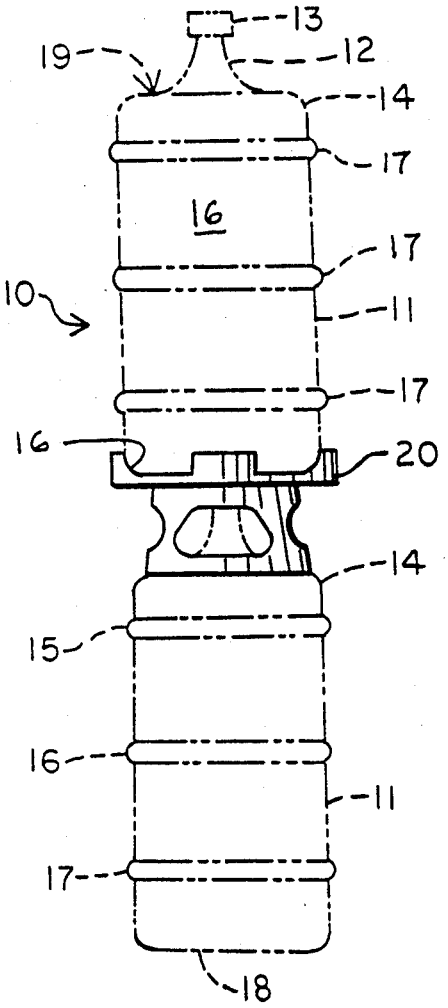
FIG. 3 is a schematic, elevational view of the preferred embodiment of the apparatus of the present invention.
Figure 1:
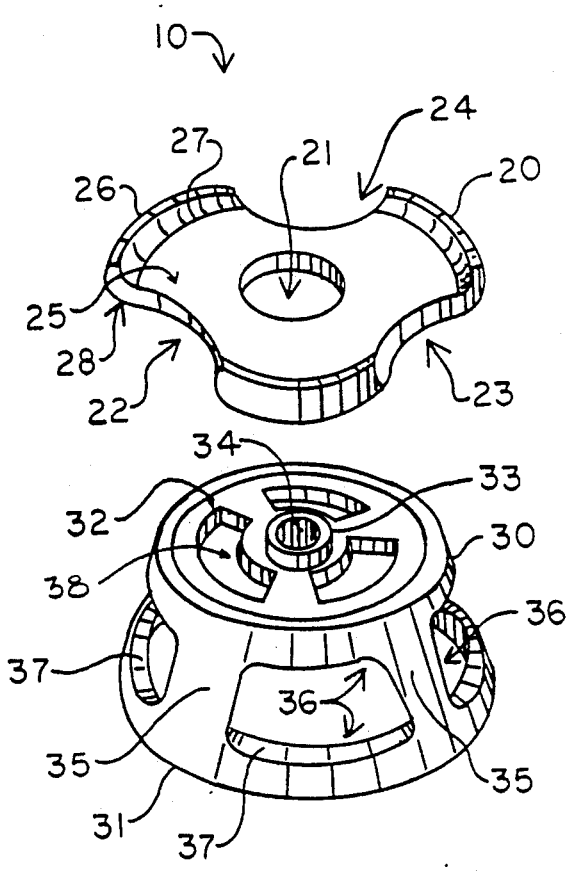
FIG. 1 is a perspective view of the preferred embodiment of the apparatus of the present invention.
Figure 2:
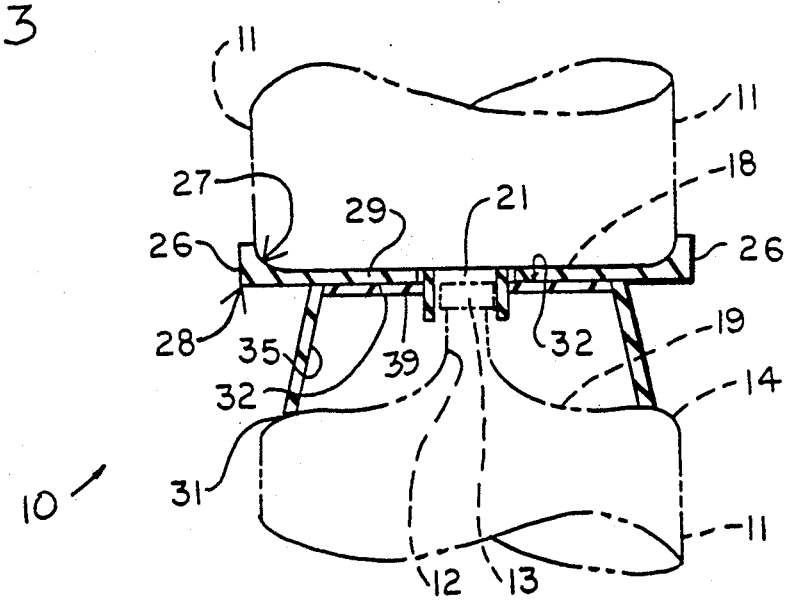
FIG. 2 is a partial sectional view of the preferred embodiment of the apparatus of the present invention.

FIGS. 1–3 show the preferred embodiment of the apparatus of the present invention designated generally by the numeral 10. Bottle stacking apparatus 10 is shown in use in FIG. 3 with a pair of typical commercially available five gallon water bottles 11, each having narrow neck 12, closure cap 13, and generally cylindrical outer side wall 15, and a generally flat bottom 18. A plurality of annular ribs 17 can be provided for structural integrity and for rolling the bottles on their side, by engaging the ribs 17 with an underlying surface, floor or the like.

The cylindrical side wall interfaces with the neck region 20 at curved annular surface 14 and annular flat surface 19 which connects with the narrow neck 12 (see FIG. 3).

The flat annular surface 19 accepts bottom support member 30 as shown in FIGS. 2 and 3. The bottom surface 18 rests upon upper support 20 as shown in FIG. 3.

In FIGS. 1 and 2, a more detailed construction of upper support 20 and bottom support 30 is illustrated. Upper support 20 includes a generally circular opening 21 that accommodates cap 13 during use as shown in FIGS. 2 and 3. Upper support 20 includes a generally horizontally extending portion 29 having three arcuate slots or recesses 22–24 formed between a plurality of three radially extending appendages 28.

Upper support 20 has a generally flat surface 25 which receives the bottom 18 of bottle 11 as shown in FIGS. 2 and 3 during use. The curved annular surface 27 of upper support 20 corresponds to the curved annular surface at the periphery of the bottom 18 of bottle 11 as shown in FIG. 2. The outer limit of each appendage 28 is defined by a curved side wall 26.

The horizontal portion 29 of upper support 20 fits on top of bottom support 30 as shown in FIGS. 2 and 3. Bottom support 30 has an annular edge 31 at its lower most portion which fits upon flat annular surface 19 of bottle 11 as shown in FIG. 2.

The bottom support 30 includes a horizontally extending portion 39 having a top surface 32 upon which upper support 30 rests during use. The center of bottom support 30 provides a cylindrical hub that can be formed integral with horizontal portion 39 as shown in FIGS. 1 and 2.

Cylindrical hub 33 extends above the top surface 32 of horizontal portion 39 so that it receives opening 21 during use as shown in FIG. 2. In this manner, the opening 21 provides an internal diameter that is equal to or slightly larger than the external diameter of cylindrical hub 33. When the upper support 20 is placed upon the lower support 30, opening 21 registers upon cylindrical hub 33. Cylindrical hub 33 is hollow providing a cylindrically shaped opening 34 which accommodates bottle cap 13 and a portion of neck 12 during use as shown in FIG. 2.

Bottom support 30 includes an inclined annular side wall 35 which can be formed integrally with horizontal portion 39 such as by plastic injection molding. The side wall 35 can have a plurality of openings 36 for weight reduction, with the wall thickness indicated as 37 in FIG. 1. Horizontal portion 39 likewise can provide a plurality of curved slots 38 for weight reduction purposes if desired.

The apparatus 10 is shown during use in FIGS. 2 and 3. In FIG. 2, the top portion of a bottle 11 is shown with the neck 12 and cap 13 portions, all in phantom lines. In FIG. 2, the lower annular edge 31 of bottom support 30 is shown resting upon flat annular surface 19 of bottle 11.

Resting upon bottom support 30 is top support 20 with the bottom 18 of a bottle 11 resting upon flat surface 25. The curved annular interface between the bottle side wall and bottom 18 correspondingly rests in the curved annular portion 27 of top support 20.

The apparatus 10 can be manufactured of any suitable structural material such as plastic injection molded, using a hard plastic. Alternately, the apparatus can be manufactured of any metallic material such as stainless steel, aluminum or the like.

The following Table 1 lists the part numbers and part descriptions as used herein and in the drawings attached hereto.

TABLE 1

| PARTS LIST | |
|---|---|
| PART NUMBER | DESCRIPTION |
| 10 | bottle stacking apparatus |
| 11 | bottle |
| 12 | neck |
| 13 | cap |
| 14 | curved annular surface |
| 15 | side wall |
| 16 | annular curved surface |
| 17 | annular rib |
| 18 | flat bottom |
| 19 | flat annular surface |
| 20 | upper support |
| 21 | circular opening |
| 22 | arcuate slot |
| 23 | arcuate slot |
| 24 | arcuate slot |
| 25 | flat surface |

TABLE 1-continued

| PARTS LIST | |
|---|---|
| PART NUMBER | DESCRIPTION |
| 26 | annular side wall |
| 27 | curved annular surface |
| 28 | radially extending appendages |
| 29 | horizontal portion |
| 30 | bottom support |
| 31 | annular edge |
| 32 | top surface |
| 33 | cylindrical herb |
| 34 | opening |
| 35 | inclined side wall |
| 36 | opening |
| 37 | wall thickness |
| 38 | curved slots |
| 39 | horizontal portion |
| 40 | |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A stacking apparatus for vertically stacking two or more narrow neck bottles, including an upper bottle and a lower bottle comprising:

a) a lowermost support including an upstanding annular sidewall with a lowermost annular surface adapted to engage the upper end portion of a lower bottle to be stacked;

b) a generally flat upper surface connected to the top end portion of the annular side wall;

c) a cylindrical hub providing an opening for accommodating the neck portion of the lower bottle;

d) an uppermost connection member that extends away from the hub providing a flat, annular area that extends beyond the annular side wall, the upper support having an upper surface that conforms generally to the bottom of an upper bottle to be stacked.

2. The stacking apparatus of claim 1 wherein the side wall is inclined.

3. The stacking apparatus of claim 1 wherein the lowermost annular surface defines a plane.

4. The stacking apparatus of claim 1 wherein the uppermost connection member comprises a horizontal member with a plurality of radially extending struts that each extend beyond the annular sidewall.

5. The stacking apparatus of claim 1 wherein the lowermost connection member includes a hollow portion that fits around the bottle neck of the lower bottle.

6. The stacking apparatus of claim 1 wherein the cylindrical hub has an inner cylindrical hub wall that defines a hollow cylindrical bore with a vertical bore axis.

7. The stacking apparatus of claim 6 wherein the inner cylindrical hub wall is closely positioned during use to the bottle neck so that the bore axis is maintained in a generally vertical orientation when the lower bottle axis is vertical.

8. The stacking apparatus of claim 1 wherein the upper and lower bottles have vertical axes respectively that align during use.

* * * * *